United States Patent [19]

Kaneko

[11] Patent Number: 4,935,591

[45] Date of Patent: Jun. 19, 1990

[54] PUSH BUTTON SWITCH

[75] Inventor: Kyoichi Kaneko, Iwaki, Japan

[73] Assignee: Alps Electric Co., Ltd., Tokyo, Japan

[21] Appl. No.: 228,664

[22] Filed: Aug. 4, 1988

[30] Foreign Application Priority Data

Nov. 5, 1987 [JP] Japan ..... 62-168441[U]
Dec. 2, 1987 [JP] Japan ..... 62-182911[U]
Apr. 12, 1988 [JP] Japan ..... 63-49142[U]

[51] Int. Cl.[5] ..... H01H 1/64

[52] U.S. Cl. ..... 200/293; 200/520; 200/341

[58] Field of Search ..... 200/11 R, 293, 341, 200/345, 520, 530, 531, 536, 303, 521; 228/215; 428/192; 29/622

[56] References Cited

U.S. PATENT DOCUMENTS 3,883,705 5/1975 Sebastian et al. ..... 200/303
4,419,555 12/1983 Kim ..... 200/345
4,467,160 8/1984 Murmann et al. ..... 200/536
4,760,225 7/1988 Takano ..... 200/303

FOREIGN PATENT DOCUMENTS 0124206 11/1984 European Pat. Off. ..... 200/520

*Primary Examiner*—Henry J. Recla
*Assistant Examiner*—Glenn T. Barrett
*Attorney, Agent, or Firm*—Guy W. Shoup; Norman R. Klivans

[57] ABSTRACT

A push button switch including a lower case, an upper case adapted to be coupled with the lower case to define a space therebetween, a fixed contact member having a fixed contact terminal, a movable contact member having a movable contact terminal, and a stem operable from the outside of the upper case, wherein the fixed contact member, the movable contact member and the stem are mounted in the space, and the lower case is formed with slots for inserting the fixed contact terminal and the movable contact terminal therethrough. The stem is slidably mounted to a stem sliding portion formed in the lower case, and a bottom portion of the stem sliding portion projects downwardly from the lower surface of the lower case less than a plurality of projections projecting downwardly from the lower surface of the lower case. The lower case is formed at its inside corners with curved surface. The bottom surface of the lower case is formed with cutouts in the vicinity of the slots.

2 Claims, 4 Drawing Sheets

PUSH BUTTON SWITCH

BACKGROUND OF THE INVENTION

The present invention relates to a push button switch for a keyboard to be used as various input devices in a personal computer, a word processor or the like.

Conventionally, such a push button switch is known from U.S. Pat. No. 4,467,160, for example.

FIG. 7 shows such a conventional push button switch in vertical section. Referring to FIG. 7, the push button switch generally consists of a lower case 1, an upper case 2, a fixed contact member 3, a movable contact member 4, a stem 5 and a coil spring 6.

The lower case 1, the upper case 2 and the stem 5 are formed of insulating synthetic resin such as polyacetal.

The lower case 1 is of a generally box-like shape having an open top. A cylindrical guide projection 7 is formed to project upwardly from an inner bottom surface of the lower case 1 at a central portion thereof. The bottom portion of the lower case 1 between the guide projection 7 and a side wall of the lower case 1 is formed with slots 8 and 9 for inserting therethrough a fixed contact terminal 17 of the fixed contact member 3 and a movable contact terminal 22 of the movable contact member 4, respectively.

The upper case 2 is of a generally box-like shape having an open bottom, and is formed at its top surface with a central opening 10 for inserting the stem 5 therethrough. An engagement element (not shown) to be engaged with a stepped portion (not shown) of the lower case 1 depends from a side wall of the upper case 2. Thus, the engagement element is engaged with the stepped portion to assemble the lower case 1 with the upper case 2.

The stem 5 comprises a base portion 12 wider than the opening 10 of the upper case 2, an upward projection 12 projecting upwardly from the base portion 12 at a central portion thereof and adapted to be inserted through the opening 10, and a downward projection 13 projecting downwardly from the base portion 11 at the central portion thereof and adapted to be inserted into the guide projection 7 of the lower case 1.

The coil spring 6 has a lower end portion 14 mounted on the outer periphery of the guide projection 7 and has an upper end portion 15 abutting against a lower surface of the base portion 11 of the stem 5, thus normally biasing the stem 5 upwardly.

The fixed contact member 3 is formed from a relatively rigid metal plate having good conductivity, and is integrally formed with a contact portion 16 and a fixed contact terminal 17 depending from a lower end of the contact portion 16.

The movable contact member 4 is formed from a resilient sheet metal such as phosphor bronze, and is integrally formed with a movable contact wide element 18 bent at the midway thereof, a contact portion 19 formed at one lower end of the contact element 18, and a pair of substantially V-shaped stem abutting portions 21 formed on opposite sides of the contact portion 19 and adapted to be urged by a pair of inclined portions 20 of the stem 5. The movable contact terminal 22 depends from the other lower end of the contact element 18.

In operation, when the stem 5 is in an undepressed or rest position, the base portion 11 of the stem 5 is biased upwardly by the coil spring 6 to an upper limit position in the upper case 2, and the stem abutting portions 21 of the movable contact member 4 is in abutment against crests of the inclined portions 20 of the stem 5. Accordingly, the contact portion 19 of the movable contact member 4 is separate from the contact portion 16 of the fixed contact member 3. Under this condition, when the stem 5 is depressed against the biasing force of the coil spring 6, the stem abutting portions 21 of the movable contact member 4 are slidingly moved along the inclined portions 20 of the stem 5 toward the stem 5 (toward the fixed contact member 3). When the stem 5 is lowered near a lower limit position, the contact portion 19 of the movable contact member 4 is brought into contact with the contact portion 16 of the fixed contact member 3, thereby turning the switch on. On the other hand, when the depression of the stem 5 is released, the stem 5 is raised by the biasing force of the coil spring 6 to move the contact portion 19 of the movable contact member 4 away from the contact portion 16 of the fixed contact member 3, thereby turning the switch off.

The terminals 17 and 22 of the movable contact member 4 and the fixed contact member 3 are soldered to a land of a printed substrate (not shown), and an outer side wall of the case of the push button switch is mounted on a panel substrate (not shown).

In the conventional push button switch as mentioned above, upon soldering of the fixed contact terminal 17 and the movable contact terminal 22 to the printed substrate, flux is applied to the terminals 17 and 22 so as to improve the solderability. However, since the flux has a good wettability to a metal surface, the flux tends to be led along the terminals 17 and 22 and be deposited to the contact portions 16 and 19. Further, when the flux enters the case through the terminals 17 and 22, it tends to be gathered at corner portions 23 in the lower case 1 due to capillarity and surface tension and be raised on the inner wall surface of the lower case 1 along the corner portions 23, resulting in depositing to the contact portions 16 and 19 and causing a defective contact.

Furthermore, the lower flat surface of the lower case 1 is entirely mounted on the printed substrate. Therefore, when the stem 5 is depressed, and the lower end of the stem 5 abuts against the inner bottom surface of the lower case 1, a large impact sound is generated.

SUMMARY OF THE INVENTION

It is a first object of the present invention to provide a push button switch which can prevent entry of the flux into the contactor.

It is a second object of the present invention to provide a push button switch which can suppress the impact sound of the stem.

According to a first aspect of the present invention, there is provided a push button switch comprising a case, a stem sliding portion provided in said case, a stem slidably mounted to said stem sliding portion, and a projection provided on a lower surface of said case for preventing entry of flux into said case, wherein a bottom portion of said stem sliding portion projects downwardly from said lower surface of said case more than said projection.

With this arrangement, a distance between a soldered portion of the terminal and the contact portion of the contactor may be made long by the provision of the projection projecting from the lower surface of the case. Therefore, upon soldering, e.g., auto-dipping, the flux is prevented from entering the contact portion. Further, as the lower case is mounted on the printed substrate by point contact rather than surface contact via the projection, the impact sound may be reduced when the stem is depressed to abut against the inner bottom surface of the lower case. Moreover, as the bottom portion of the stem sliding portion projects downwardly from the lower surface of the case, the height of the switch may be reduced with the same sliding stroke of the stem as the prior art. Additionally, as a portion of the stem normally slidingly contacting the stem sliding portion of the case is long, the stem may be stably supported to thereby prevent the looseness of the stem.

According to a second aspect of the present invention, there is provided in a push button switch including a case, contactor provided in said case, and a terminal extending from said contactor and projecting out of said case; the improvement comprising a corner portion formed by inner wall surfaces of said case in the vicinity of said terminal, said corner portion being formed with a curved surface.

With this arrangement, even when the flux enters the case along the terminal, the curved surface of the corner portion of the case prevents the flux from being gathered at the corner portion due to capillaris and surface tension, thereby preventing the flux from being raised along the corner portion and reaching the contact portion.

According to a third aspect of the present invention, there is provided in a push button switch including a lower case, an upper case adapted to be coupled with said lower case to define a space therebetween, a fixed contact member having a fixed contact terminal, a movable contact member having a movable contact terminal, and a stem operable from the outside of said upper case, wherein said fixed contact member, said movable contact member and said stem are mounted in said space, and said lower case is formed with slots for inserting said fixed contact terminal and said movable contact terminal therethrough; the improvement comprising a cutout formed at a portion of a bottom surface of said lower case in the vicinity of said slots and a plurality of projections provided on said bottom surface, said slots being located over said bottom surface.

With this arrangement, a distance from soldered portions of the terminals to the slots may be made long by the provision of the plural projections projecting downwardly from the lower surface of the lower case and the provision of the cutout in the vicinity of the slots. Accordingly, upon auto-dipping, the flux may be prevented from entering the lower case from the terminals. Furthermore, as the lower case is mounted on the printed substrate by point contact rather than surface contact via the projections, the impact sound may be reduced when the stem is depressed to abut against the inner bottom surface of the lower case.

Other objects and features of the invention will be more fully understood from the following detailed description and appended claims when taken with the accompanying drawings.

DETAILED DESCRIPTION OF THE PREFERRED EMBODIMENT

Figure 1:
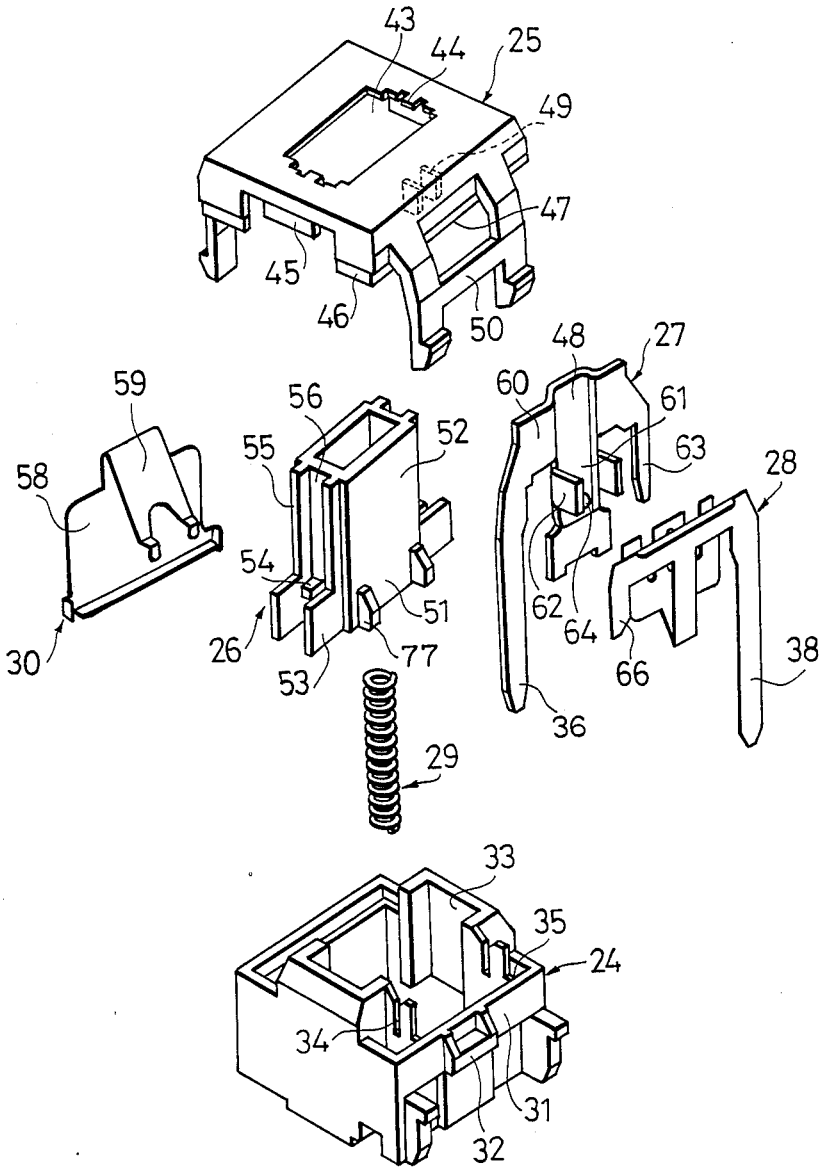
FIG. 1 is an exploded perspective view of the push button switch according to the present invention.

There will now be described a preferred embodiment of the present invention with reference to FIGS. 1 to 6.

The push button switch of the present invention primarily comprises a lower case 24, an upper case 25, a stem 26, a fixed contact member 27, a movable contact member 28, a coil spring 29 normally biasing the stem 26 upwardly, and a leaf spring 30 for providing click feeling. The lower case 24, the upper case 25 and the stem 26 are formed of an electrically insulating synthetic resin. The fixed contact member 27 and the movable contact member 28 are formed of a metal material having good conductivity.

The lower case 24 is of a generally box-like shape having an open top. (Opposite side walls 31 of the lower case 24 are formed on their outer surface with a pair of stepped portions 32 for detachably engaging the upper case 25.) Opposite side walls adjacent the side walls 31 are formed with a pair of guide rails 33 for guiding the stem 26. That is, the stem 26 is adapted to slidingly engage the guide rails 33. There are provided between the side wall 31 and the guide rails 33 a pair of mount portions 34 for mounting the fixed contact member 27 and a pair of mount portions 35 for mounting the movable contact member 28. One of the mount portions 34 is formed at its bottom with a slot 37 through which a fixed contact terminal 36 of the fixed contact member 27 is inserted and led to the outside (See FIGS. 3 and 6). Similarly, one of the mount portions 35 is formed at its bottom with an arcuate slot 39 through which a movable contact terminal 38 of the movable contact member 28 is inserted and led to the outside (See FIGS. 3 and 6).

Figure 4:
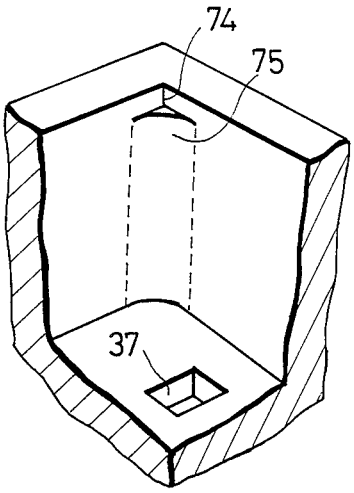
FIG. 4 is a perspective view of the corner portion of the lower case.
Figure 3:
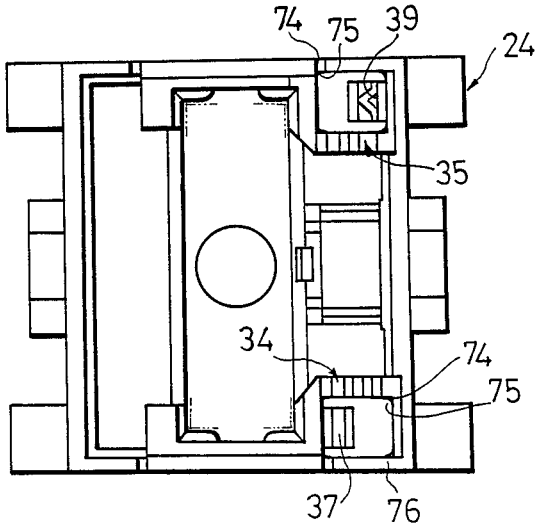
FIG. 3 is a top plan view of the lower case of the push button switch.

As shown in FIGS. 3 and 4, four corners 74 formed by each mount portion 34, each mount portion 35 and side wall of the lower case 24 are formed with curved portions 75 each having a curved inside surface. Each curved portion 75 has an upper end surface lower than an upper end surface 76 of the lower case 24, so that a gap is defined between the curved portion at each corner and the upper end surface 76 of the lower case 24 so as to prevent flux from reaching a contact portion between the movable and fixed contact members.

Figure 2:
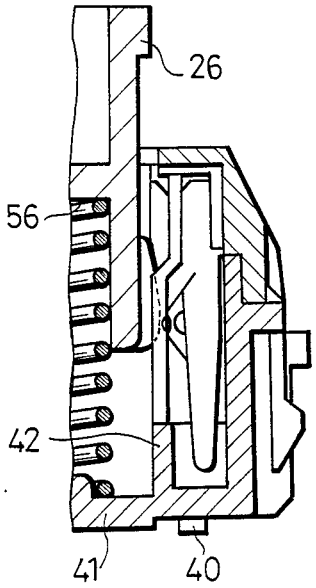
FIG. 2 is a vertical sectional view of an essential part of the push button switch according to the present invention.
Figure 6:
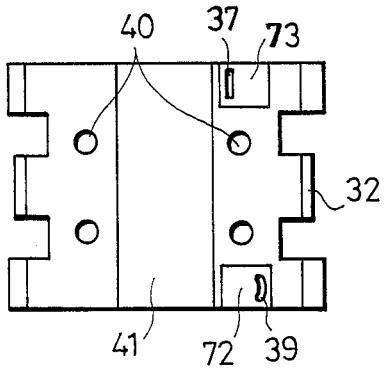
FIG. 6 is a bottom plan view of the lower case.
Figure 7:
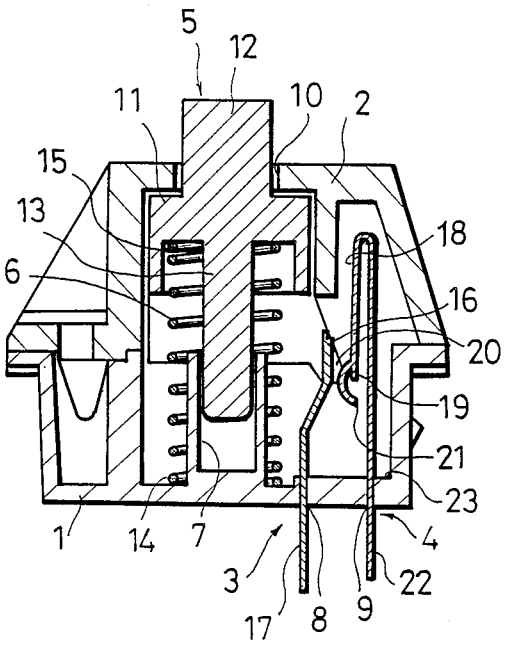
PRIOR ART Fig.7
FIG. 7 is a vertical sectional view of an essential part of the conventional push button switch.

As shown in FIGS. 2 and 6, four projections 40 are provided on the lower surface of the lower case 24. A bottom portion 41 of the lower case 24 against which the stem 26 guided by the guide rails 33 abuts projects downwardly from the lower surface of the lower case 24. An amount of projection of the bottom portion 41 is set to be smaller than that of the projections 40. Further, the lower case 24 is formed with cutouts 72 and 73 in the vicinity of the slots 37 and 39, respectively. There is provided below and between the mount portions 34 a substantially U-shaped projection 42 for preventing a dust from entering the contact portion.

Referring back to FIG. 1, the upper case 25 has a substantially rectangular central opening 43 through which the stem 26 is inserted. The central opening 43 is formed at its opposite sides with a pair of resilient projections 44. A pair of positioning projections 45 project downwardly from a lower surface of the upper case 25 in the vicinity of the central opening 43. The positioning projections 45 are designed to abut against the inner surfaces of upper portions of the guide rails 33. The upper case 25 is formed at its lower end with peripheral projections 46 and intermediate projections 47. These projections 46 and 47 are designed to engage the inner surface of the upper end portion of the lower case 24. A pair of parallel projections 49 are provided to project downwardly from the lower surface of the upper case 25. The parallel projections 49 are designed to be inserted into a stepped portion 48 of the fixed contact member 27. Opposite sides of the upper case 25 are formed with a pair of pawls 50 designed to engage the associated stepped portions 32 of the lower case 24. Thus, the lower case 24 and the upper case 25 are assembled as a unit by engaging the pawls 50 of the upper case 50 with the stepped portions 32 of the lower case 24.

The stem 26 primarily comprises a base portion 51 having a width greater than that of the substantially rectangular opening 43 of the upper case 25 and a projecting portion 52 projecting upwardly from the base portion 51 and adapted to be inserted through the opening 43. The base portion 51 is formed at its opposite sides with a pair of sliding portions 53 to be slidingly engaged with the guide rails 33 of the lower case 24. Each of the sliding portions 53 is formed by a pair of parallel plate-like projections. A resilient projection 54 is formed between the parallel plate-like projections. The projecting portion 52 is formed at its opposite sides with a pair of grooves 56 each defined by a pair of parallel rib-like projections 55. The pair of grooves 56 are designed to receive the pair of resilient projections 44 formed at the opening 43 of the upper case 25. The base portion 51 is formed at its side wall to be opposed to the side wall 31 of the lower case 1 with a pair of inclined portions 72 for operating the movable contact member 28. In mounting the stem 26, the sliding portions 53 are engaged with the guide rails 33 of the lower case 24, and the projecting portion 52 is inserted through the opening 43 of the upper case 25. Thus, the stem 26 is disposed within a space defined between the lower case 24 and the upper case 25.

Referring to FIGS. 1 and 2, the coil spring 29 is interposed between the inner bottom surface of the lower case 24 and a stopper formed in the stem 26 in such a manner that the stem 26 is normally upwardly biased by the coil spring 29.

The leaf spring 30 for providing click feeling is generally composed of a straight base portion 58 and a flexible portion 59 extending upwardly from the base portion 58 and bent downwardly at the midway thereof. The flexible portion 59 has a forked end to be located below the lower surface of the stem 26 when the stem 26 is at an undepressed or rest position.

The fixed contact member 27 is formed from a metal (e.g., brass) plate having good conductivity, and it is integrally formed with a horizontally extending base portion 60, a stepped portion 48 extending downwardly from a substantially central portion of the base portion 60 and having a contact portion 61, a pair of dust protective walls 62 projecting from a central portion of the stepped portion 48 in such a manner as to surround the contact portion 61, a fixed contact terminal 36 extending downwardly from one side of the base portion 60, and a reinforcement leg 63 extending downwardly from the other side of the base portion 60. A part, which is formed by punching a gold laminated plate and then drawing it, 64 is formed at a substantially central portion of the contact portion 61. The fixed contact terminal 36 is inserted through the slot 37 of the lower case 24, and the base portion 60 is fitted with the mount portions 34 of the lower case 24, thereby mounting the fixed contact member 27 to the lower case 24. Under the mounted condition of the fixed contact member 27, the lower end of the stepped portion 48 abuts against the upper end of the projection 42 of the lower case as shown in FIG. 2.

Figure 5:
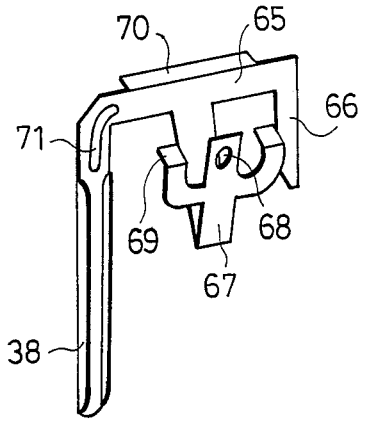
FIG. 5 is a perspective view of the movable contact member in the push button switch.

Referring to FIG. 5, the movable contact member 28 is formed from a metal (e.g., phosphor bronze) sheet having good elasticity and conductivity, and it is integrally formed with a horizontally extending base portion 65, a movable contact terminal 38 extending downwardly from one end of the base portion 65 and having an arcuate shape in horizontal cross section, a reinforcement leg 66 extending downwardly from the other end of the base portion 65, a movable contact element 67 extending downwardly from a substantially central portion of the base portion 65 and bent upwardly at the midway thereof, a contact portion 68 formed at a free end portion of the movable contact element 67, a pair of stem abutting portions 69 formed on opposite sides of the contact portion 68, and a base portion retainer tab 70 projecting laterally from an upper edge of the base portion 65. A reinforcing rib 71 is formed between the movable contact terminal 38 and the base portion 65 in such a manner as to project outwardly, so as to absorb stress to be generated in the movable contact member 28 upon depression of the stem 26. The movable contact terminal 38 is inserted through the slot 39 of the lower case 24, and the base portion 65 is fitted with the mount portions 35 of the lower case 24, thereby mounting the movable contact member 28 to the lower case 24. Under the mounted condition of the movable contact member 28, the base portion retainer tab 70 is sandwiched between the upper end of the lower case 24 and the lower end of the upper case 25.

In operation, when the stem 26 is depressed against a biasing force of the coil spring 29, the stem abutting portions 69 and the contact portion 68 of the movable contact member 28 are moved along the inclined portions 72 of the stem 26 toward the fixed contact member 27, and when the stem 26 is lowered near a lowermost position, the contact portion 68 of the movable contact member 28 is brought into contact with the contact portion 61 of the fixed contact member 27, thus turning the switch on. Simultaneously, the forked end of the flexible portion 59 of the leaf spring 30 for providing click feeling is urged by the lower end of the stem 26, thereby generating click feeling. When the depression of the stem 26 is released, the stem 26 is raised by the biasing force of the coil spring 29 to thereby separate the contact portion 68 of the movable contact member 28 from the contact portion 61 of the fixed contact member 27, thus turning the switch off.

As described above, owing to the provision of the cutouts 73 and 72 in the vicinity of the slots 37 and 39 of the lower case 24 and the provision of the four projections 40 projecting from the lower surface of the lower case 24, a distance between a soldered portion of the terminal 36 and the slot 37 and a distance between a soldered portion of the terminal 38 and the slot 39 are increased. As a result, a distance between the soldered portion of the terminal 36 and the contact portion 61 and a distance between the soldered portion of the terminal 38 and the contact portion 68 are increased. Accordingly, the flux is prevented from entering the contact portions. Furthermore, as the lower case 24 is mounted on the printed substrate by point contact rather than surface contact via the four projections 40, the impact sound may be reduced when the stem 26 is depressed to abut against the inner bottom surface of the lower case 24.

Further, as the corner portions 74 positioned in the vicinity of the terminals 38 and 36 are formed with the curved portions 75, the flux entering the lower case 24 along the terminals 38 and 36 is prevented from being gathered at the curved portions 75. Accordingly, it is possible to prevent the flux from being raised along the curved portions 75 by the capillarity and surface tension, thereby preventing the deposition of the flux to the contact portions 61 and 68.

Moreover, as the bottom portion of the lower case 24 against which the stem 26 abuts projects downwardly from the lower surface of the lower case 24, the stem 26 is allowed to be lowered more than the stem of the conventional push button switch. Accordingly, assuming that the stroke of the stem 26 is equal to that of the conventional stem, the height of the push button switch may be reduced, and the looseness of the stem 26 may be prevented.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. In a push button switch including a case, a first contactor in said case, a second contactor in said case for closing the switch when in contact with said first contactor, and a terminal extending from said first contactor and projecting out of said case; the improvement comprising a corner portion formed by inner wall surfaces of said case in the vicinity of said terminal, said corner portion being formed with a curved surface only partly along said corner portion, wherein a ledge is defined by said curved surface and said inner wall surfaces.

2. A push button switch as in claim 1, further comprising:

a stem sliding portion provided in said case;

a stem slidably mounted on said stem sliding portion for pushing together said first and second contactors to close the switch; and a projection provided on a lower surface of said case, wherein a bottom portion of said stem sliding portion projects downwardly from said lower surface of said case less than does said projections.

* * * * *